United States Patent [19]

Heimel et al.

[11] Patent Number: 4,509,274

[45] Date of Patent: Apr. 9, 1985

[54] EQUIPMENT FOR DRYING LENGTHS OF MATERIALS

[75] Inventors: Helmut Heimel; Willy Schlosser; Alfred Luttenberger, all of Graz, Austria

[73] Assignee: Maschinenfabrik Andritz Actiengesellschaft, Graz, Austria

[21] Appl. No.: 451,954

[22] Filed: Dec. 21, 1982

[51] Int. Cl.[3] ..... F26B 13/08

[52] U.S. Cl. ..... 34/114; 34/116; 34/229

[58] Field of Search ..... 34/114, 116, 122, 123, 34/222, 229

[56] References Cited

U.S. PATENT DOCUMENTS 3,388,479 6/1968 Gardner ..... 34/116

FOREIGN PATENT DOCUMENTS 293859 2/1970 Austria .

*Primary Examiner*—Larry I. Schwartz

*Attorney, Agent, or Firm*—Frost & Jacobs

[57] ABSTRACT

In equipment for drying lengths of materials, in particular lengths of paper, with the length being guided by means of a permeable belt in a semi-circle around a drying drum and being deflected by a guide roller toward a next drying drum which is enveloped in the same manner, with blow boxes being arranged between the drums to supply the drying medium, the improvement comprising means mounting blow-out sections (7) of the blow boxes (3) in a displaceable manner in the radial direction of the drying drums (1, 2) within a frame (12), and means whereby the sections can be returned into their initial positions.

3 Claims, 1 Drawing Figure

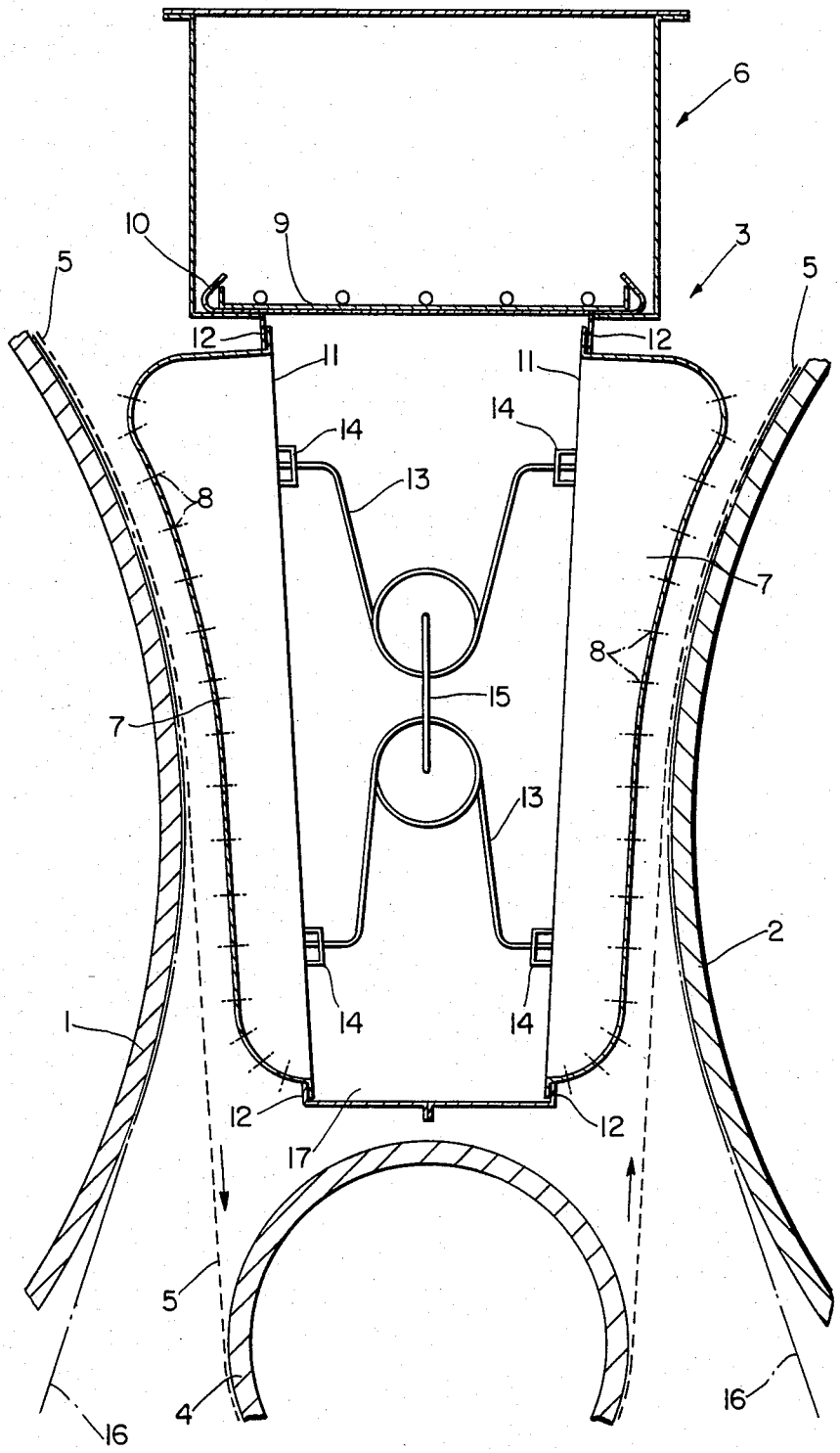
6
10
9
3
5
5
12
12
11
11
14
14
13
8
7
8
15
7
13
2
1
14
14
12
12
17
5
4
16
16

EQUIPMENT FOR DRYING LENGTHS OF MATERIALS

This invention relates to equipment for drying lengths of materials, especially lengths of paper being guided by a permeable belt in a semi-circular path around a drying drum and being moved by a guide roller to the next drying drum which is enveloped in similar manner, with blow boxes being arranged between the drums to supply the drying medium.

It is known to use apparatuses for drying lengths of materials wherein the drying medium is uniformly distributed across the length of paper by means of blow boxes and is evacuated thereafter through separate conduits.

As regards papermaking, a sifting belt together with the length of material is made to pass over drums of large diameters in a drying section in order to achieve the largest possible drying zone for a given machine compactness. The lengths of paper are deflected in S-like manner around the drums and sifting belt by means of a guide roller and are moved to the next drum. To achieve effective drying, the space between the drum is used to seat blow boxes. These contain a number of nozzles or at least orifices directed perpendicularly to the length of material, and in this manner the jet of gas of the drying medium is blown directly onto the length of material.

Austrian Pat. No. 293,859 suggests to so design the blow boxes that they assume the same contour as the drying drums in order to thereby achieve drying across a relatively large area. Special care must be taken to ensure that the spacing between the exhaust section and the length of material is not unduly small as the length of paper to be dried recurrently will be irregular and tends to form nodules. Considering the high rates of motion involved, inevitably these paper nodules will strongly impact the exhaust sections and thereby these exhaust sections become inoperative within short times. Consequently, the paper machine must be shut down so that repairs can be made.

Furthermore, the known apparatus has the drawback that the admissible spacing required to prevent nodule formation must be excessive and the drying efficiency is impaired.

In view of this state of the art, the present invention addresses the problem of providing equipment making possible an increase in efficiency in such a manner that the blow-out sections can be moved substantially closer to the length of material without thereby incurring the danger of destroying the blow-out sections in case of irregularities, that is nodule-formation, in the length of paper. This object is achieved by the present invention in that the blow boxes are mounted displaceably in the radial direction of the drying drums and are guided within the box frame, with return to their initial position being made possible by spring elements.

In order to implement in a simple manner the return into the initial position, a further feature of the invention provides that the spring elements are symmetrically opposite compression springs, the ends of which act on a fixing means mounted to the frame of the blow-out sections.

The invention will be further illustrated by reference to the accompanying drawing, which is a cross-section of a displaceable blow box between drying drums.

Drums 1 and 2 are shown in the FIGURE as curved double lines on both sides, and at least a half-circle of the sifting belt 5 is made to pass over them. The sifting belt 5 is made to move by means of the guide roller 4 to the next drum 2. A space remains between the drums 1, 2 within which is mounted the blow box 3. This blow box is composed of a manifold chamber 6 and the blow-out sections 7. A discharge aperture, which can be closed by a slider 9 is located at the lower part of the manifold chamber 6. The slider 9 is guided within a rail 10. The drying medium is guided toward the blow-out sections 7 through an aperture below. The blow-out sections 7 represent an omnidirectionally sealed construction component, a number of blow-out nozzles 8 pointing perpendicularly to the length of paper 16. Furthermore, the blow-out sections are designed in such a manner that a minimal spacing of 22 to 25 mm remains in the area of the drying zone. The blow-out sections 7 are provided at their interior with an externally pointing flange 11 which rests in sealing manner against the frame 12 of the frame box 17. These blow-out sections 7 are displaceable in the radial direction of the drums and are pressed by springs against the frames 12. Fixing means 14 regularly arranged about the center are also provided at the frame, and the ends of the return springs 13 are fastened to these means 14. These returns springs 13 are arranged in a symmetrical manner in the blow box 3 and are in the form of compression springs. A guide means 15 in the two cylindrical parts of the return springs 13 insures that they cannot move during operation.

Because of this special design of the displaceable blow boxes, the spacing between the blow-out nozzles and the length of material—which conventionally is 40 mm as a rule—now can be reduced to about 22 to 25 mm. As a result, the efficiency in drying is substantially increased as now intensive blow-out of the drying medium is possible and, in the event of any nodule formation, the blow-out sections can easily move out of the way without damage to the nozzle apertures thereof. This provides an advantageous longer service life for both the blow-out sections and the sifting belt.

It will be obvious to those skilled in the art that many modifications may be made within the scope of the present invention without departing from the spirit thereof, and the invention includes all such modifications.

What we claim is:

1. In equipment for drying lengths of material, in particular webs of paper, with the web being guided by means of a continuous permeable belt around an arc of a drying drum and being deflected by a guide roller toward a next drying drum which is enveloped in the same manner, blow boxes comprising blowout sections having apertures for directing a drying medium against the web, said blowout sections being arranged between said drums, in spaced relation to said guide roller and within the loop formed by said continuous permeable belt, said blow boxes having walls adjacent the surfaces of adjacent drying drums, the improvement comprising means mounting said blowout sections having apertures in a displaceable manner in the radial direction of the drying drums within a frame so as to allow for movement of the apertured blowout sections away from the drying drums when an irregularity in the material, such as a nodule, passes between the drying drums and apertured blowout sections, and means whereby said sections can be returned into their initial positions.

2. Equipment according to claim 1, in which said return means are springs.

3. Equipment according to claim 2, in which the springs (13) are symmetrically opposite compression springs, the ends of which act on fixing means (14) mounted at the frame (12) of the blow-out sections (7).

* * * * *